US009864289B2

(12) United States Patent
Nishitera et al.

(10) Patent No.: US 9,864,289 B2
(45) Date of Patent: Jan. 9, 2018

(54) ELECTROSTATIC LATENT IMAGE DEVELOPING TONER

(71) Applicant: KYOCERA Document Solutions Inc., Osaka (JP)

(72) Inventors: Haruhiro Nishitera, Osaka (JP); Tomoyasu Asakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/439,970

(22) Filed: Feb. 23, 2017

(65) Prior Publication Data

US 2017/0248860 A1 Aug. 31, 2017

(30) Foreign Application Priority Data

Feb. 25, 2016 (JP) ..... 2016-034337
Nov. 10, 2016 (JP) ..... 2016-219506

(51) Int. Cl.
*G03G 9/093* (2006.01)
*G03G 9/08* (2006.01)
*G03G 9/097* (2006.01)

(52) U.S. Cl.
CPC ..... *G03G 9/09321* (2013.01); *G03G 9/0819* (2013.01); *G03G 9/0825* (2013.01); *G03G 9/09371* (2013.01); *G03G 9/09725* (2013.01); *G03G 9/09733* (2013.01)

(58) Field of Classification Search
CPC ..... G03G 9/09321; G03G 9/09371; G03G 9/09342; G03G 9/09733; G03G 9/09725; G03G 9/0825
USPC ..... 430/110.2
See application file for complete search history.

(56) References Cited

U.S. PATENT DOCUMENTS 8,940,468 B2 1/2015 Aoki et al.
9,791,798 B2 * 10/2017 Nishitera ..... G03G 9/09321
2013/0011777 A1 1/2013 Aoki et al.

FOREIGN PATENT DOCUMENTS

JP 2013-019971 A 1/2013

* cited by examiner

*Primary Examiner* — Janis L Dote
(74) *Attorney, Agent, or Firm* — Studebaker & Brackett PC

(57) ABSTRACT

An electrostatic latent image developing toner includes a plurality of toner particles each including a core containing a binder resin and a shell layer covering a surface of the core. The shell layer contains a copolymer of at least two vinyl compounds including a compound represented by the following formula (1). The toner contains a ring unopened oxazoline group in an amount of at least 0.10 μmol/g and no greater than 100 μmol/g.

(1)

12 Claims, 2 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2016-034337, filed on Feb. 25, 2016 and Japanese Patent Application No. 2016-219506, filed on Nov. 10, 2016. The contents of these applications are incorporated herein by reference in their entirety.

BACKGROUND

The present disclosure relates to electrostatic latent image developing toners, and in particular relates to a capsule toner.

There has been known a technique for improving preservability of a toner by for example using a reactive polymer having an oxazoline group as a crosslinking agent.

SUMMARY

An electrostatic latent image developing toner according to the present disclosure includes a plurality of toner particles each including a core containing a binder resin and a shell layer covering a surface of the core. The shell layer contains a copolymer of at least two vinyl compounds including a compound represented by formula (1) shown below. The toner contains a ring unopened oxazoline group in an amount of at least 0.10 μmol/g and no greater than 100 μmol/g.

(1)

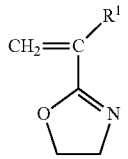

In formula (1), $R^1$ represents a hydrogen atom or an optionally substituted alkyl group.

DETAILED DESCRIPTION

Figure 1:
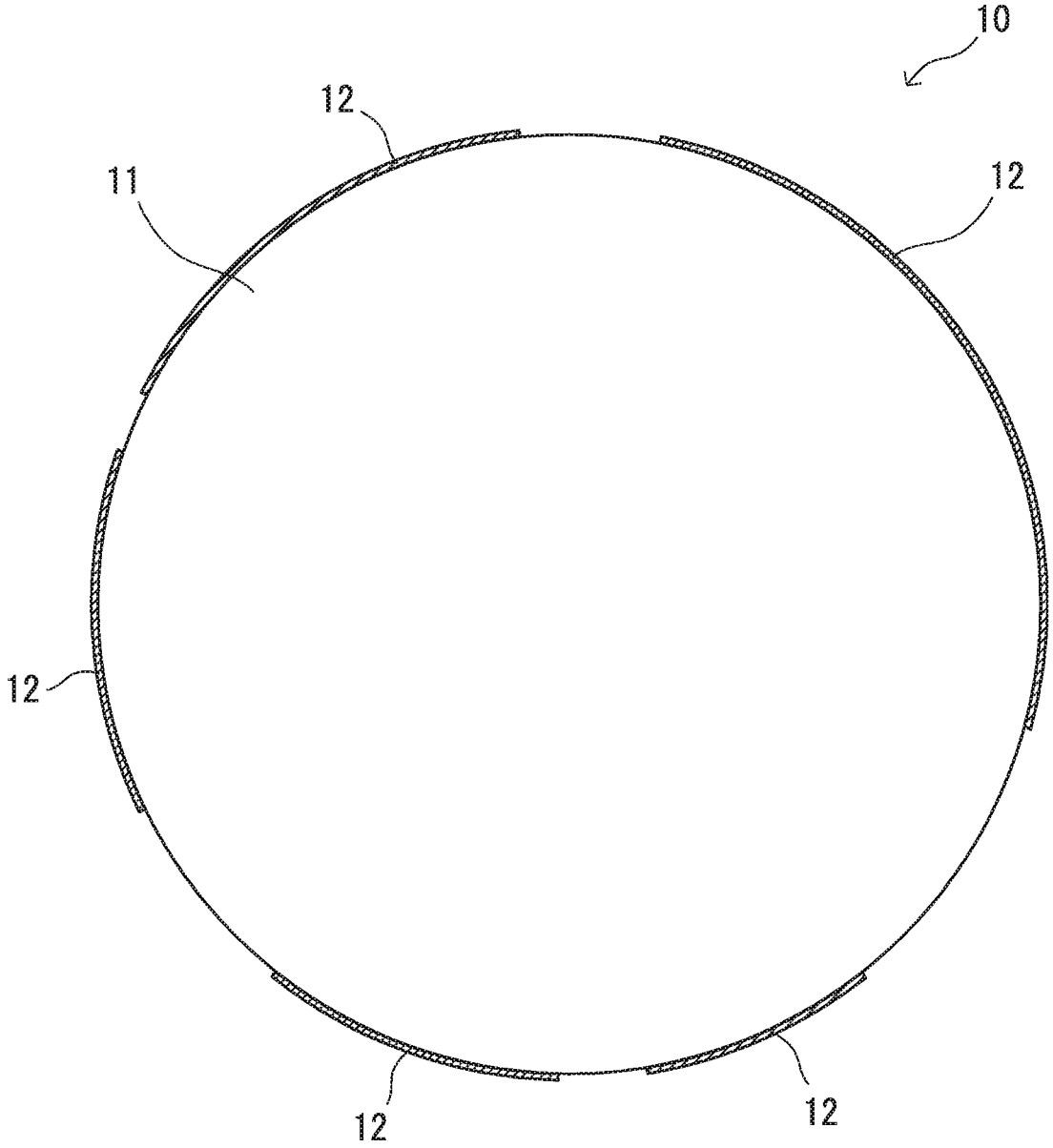
FIG. 1 is a diagram illustrating one example of sectional stricture of a toner mother particle in an electrostatic latent image developing toner according to an embodiment of the present disclosure.

The following explains an embodiment of the present disclosure in detail. Unless otherwise stated, evaluation results (for example, values indicating shape and physical properties) for a powder (specific examples include toner cores, toner mother particles, an external additive, and a toner) are number averages of values measured for a suitable number of representative particles.

Unless otherwise stated, the number average particle diameter of a powder is a number average value of diameters of representative circles of primary particles (i.e., diameters of circles each having the same surface area as a projection of the particle) measured using a microscope. Unless otherwise stated, a measurement value of the volume median diameter ($D_{50}$) of a powder is a value measured using a laser diffraction/scattering particle size distribution analyze ("LA-750" manufactured by HORIBA, Ltd.). Unless otherwise stated, a glass transition point (Tg) is a value measured using a differential scanning calorimeter ("DSC-6220" manufactured by Seiko Instruments Inc.) in accordance with "Japan Industrial Standard (JIS) K7121-2012". On a heat absorption curve (vertical axis: heat flow (DSC signals), horizontal axis: temperature) at a second temperature increase measured by the differential scanning calorimeter, a temperature (onset temperature) at a point of variation in specific heat (an intersection point of an extrapolation of the base line and an extrapolation of the inclined portion of the curve) corresponds to a Tg (glass transition point). Furthermore, unless otherwise stated, a softening point (Tm) is a value measured using a capillary rheometer ("CFT-500D" manufactured by Shimadzu Corporation). On an S-shaped curve (horizontal axis: temperature, vertical axis: stroke) measured by the capillary rheometer, a temperature at "(base line stroke value+maximum stroke value)/2" corresponds to a Tm (softening point). Respective measurement values of an acid value and a hydroxyl value are values measured in accordance with Japan Industrial Standard (JIS) K0070-1992 unless otherwise stated. A number average molecular weight (Mn) and a mass average molecular weight (Mw) are values measured by gel permeation chromatography unless otherwise stated.

Unless otherwise stated, chargeability means a chargeability at triboelectric charging. Intensity of positive chargeability (or negative chargeability) at the triboelectric charging can be determined using for example a known triboelectric series.

In the present specification, the term "silica particles" refers to both untreated silica particles and silica particles (surface treated silica particles) obtained by surface treatment on a silica base material (untreated silica particles).

In the present specification, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. In the present specification, the term "(meth)acryl" is used as a generic term for both acryl and methacryl. Acrylonitrile and methacrylonitrile may be referred collectively to as "(meth)acrylonitrile". Furthermore, subscripts "n" of respective repeating units in chemical formulas each represent, independently of one another, the number of repetitions (number of moles) of the repeating unit. Unless otherwise stated, n (the number of repetitions) is any suitable value.

A toner according to the present embodiment can favorably be used as for example a positively chargeable toner for development of an electrostatic latent image. The toner according to the present embodiment is a powder containing a plurality of toner particles (particles each having features described later in detail). The toner may be used as a one-component developer. Alternatively, the toner may be mixed with a carrier using a mixer (for example, a ball mill) to prepare a two-component developer. A ferrite carrier is preferably used as the carrier in order to form a high-quality image. It is preferable to use magnetic carrier particles each including a carrier core and a resin layer that covers the carrier core in order to form high-quality images for a long period of time. Carrier cores may be formed from a magnetic material (for example, a ferrite) or a resin in which magnetic particles are dispersed in order to impart magnetism to the carrier particles. Alternatively, magnetic particles may be dispersed in resin layers that cover respective carrier cores. The amount of the toner in a two-component developer is preferably at least 5 parts by mass and no greater than 15 parts by mass relative to 100 parts by mass of the carrier in order to form a high-quality image. Note that a positively chargeable toner contained in a two-component developer is positively charged by friction with a carrier.

The toner particles contained in the toner according to the present embodiment each include a core (also referred to below as a toner core) containing a binder resin and a shell layer (capsule layer) covering a surface of the toner core. The toner core may optionally contain an internal additive (for example, at least one of a colorant, a releasing agent, a charge control agent, and a magnetic powder). The shell layer is formed substantially from a resin. For example, covering toner cores that melt at low temperature with shell layers excellent in heat resistance can achieve a toner excellent in both high-temperature preservability and low-temperature fixability. An additive may be dispersed in the resin forming the shell layers. An external additive may be attached to the surfaces of the shell layers (or surface regions of the toner cores that each are not covered with a shell layer). Furthermore, a plurality of shell layers may be stacked on the surface of the toner core. Note that the external additive may be omitted in a situation in which such an additive is not necessary. Hereinafter, toner particles that are yet to be subjected to addition of an external additive are referred to as toner mother particles. A material for forming the shell layers is referred to as a shell material.

The toner according to the present embodiment can be used for example for image formation using an electrophotographic apparatus (image forming apparatus). The following describes an example of an image forming method using an electrophotographic apparatus.

First, an image forming section (a charger and an exposure device) of the electrophotographic apparatus forms an electrostatic latent image on a photosensitive member based on image data. Subsequently, a developing device (specifically, a developing device charged with a developer containing toner) of the electrophotographic apparatus supplies the toner to the photosensitive member to develop the electrostatic latent image formed on the photosensitive member. The toner is charged by friction with a carrier or a blade in the developing device before being supplied to the photosensitive member. For example, a positively chargeable toner is charged positively. In a developing process, toner (specifically, charged toner) on a developing sleeve (for example, a surface layer portion of a development roller in the developing device) disposed in the vicinity of the photosensitive member is supplied to the photosensitive member to be attached to the electrostatic latent image on the photosensitive member, thereby forming a toner image on the photosensitive member. The developing device is replenished with toner for replenishment use from a toner container in compensation for consumed toner.

In a subsequent transfer process, a transfer device of the electrophotographic apparatus transfers the toner image on the photosensitive member to an intermediate transfer member (for example, a transfer belt) and further transfers the toner image on the intermediate transfer member to a recording medium (for example, paper). Thereafter, a fixing device (fixing method: nip fixing using a heating roller and a pressure roller) of the electrophotographic apparatus applies heat and pressure to the toner to fix the toner to the recording medium. As a result, an image is formed on the recording medium. A full-color image can be formed by superimposing toner images formed using different four color toners such as black, yellow, magenta, and cyan. After the transfer process, residual toner on the photosensitive member is removed by a cleaning member (for example, a cleaning blade). Note that the transfer process may be a direct transfer process by which a toner image on the photosensitive member is transferred directly to the recording medium not via the intermediate transfer member. A belt fixing method may be adopted as a fixing method.

The toner according to the present embodiment is an electrostatic latent image developing toner having the following features (also referred to below as basic features).

(Basic Features of Toner)

The electrostatic latent image developing toner contains a plurality of toner particles each including a toner core and a shell layer. The shell layer contains a copolymer of at least two vinyl compounds including a compound represented by the above formula (1). The toner contains a ring unopened oxazoline group in an amount of at least 0.10 μmol/g and no greater than 100 μmol/g. Note that the amount of the unopened oxazoline group is measured by a method described in Examples or an alternative method thereof.

The vinyl compounds each are a compound having a vinyl group ($CH_2$=CH—) or a compound having a substituted vinyl group. Examples of the vinyl compounds include ethylene, propylene, butadiene, vinyl chloride, acrylic acid, methyl acrylate, methacrylic acid, methyl methacrylate, acrylonitrile, and styrene. The vinyl compounds can each be a polymer (resin) through addition polymerization by carbon double bonding "C=C" included in for example the vinyl group.

The compound represented by the above formula (1) (referred to below as a compound (1)) becomes a repeating unit represented by the following formula (1-1) through addition polymerization to constitute a copolymer.

(1-1)

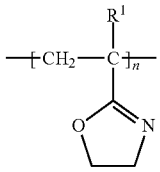

The repeating unit represented by formula (1-1) (referred to below as a repeating unit (1-1)) has a ring unopened oxazoline group. The ring unopened oxazoline group has cyclic structure to exhibit strong positive chargeability. The ring unopened oxazoline group tends to react with a carboxyl group, an aromatic sulfanyl group, or an aromatic hydroxyl group. For example, when the repeating unit (1-1) reacts with a carboxyl group present on the surface of a resin $R^0$, the ring of the oxazoline group is opened as indicated in the following formula (1-2) to form an amide ester bond. The repeating unit represented by formula (1-2) is referred to below as a repeating unit (1-2).

(1-2)

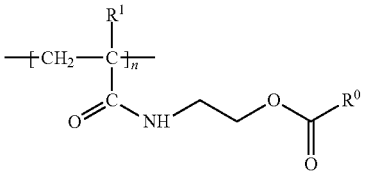

The shell layers in the toner having the aforementioned basic features contain a copolymer of at least two vinyl compounds including a compound represented by the above formula (1) (also referred to below as a specific copolymer). The specific copolymer is a copolymer of at least one vinyl compound represented by the above formula (1) and at least one vinyl compound other than the vinyl compound represented by formula (1). In the above configuration, the repeating unit (1-1) is present in a resin (specifically, the specific copolymer) forming the shell layers. The oxazoline group in the repeating unit (1-1) is ring-opened for example through a reaction with a functional group present on the surface of the binder resin forming the toner cores. The ring-opened oxazoline group can form cross-linking structure. In a configuration for example in which the binder resin of the toner cores is a polyester resin, it is thought that the oxazoline group in the repeating unit (1-1) reacts with a carboxyl group of the polyester resin (resin $R^0$ indicated in formula (1-2)) to generate the repeating unit (1-2). Once the shell layers forms the cross-linking structure, positive chargeability of the shell layers may be impaired while heat resistance of the toner tends to be improved in the presence of the cross-linking structure.

In view of the above knowledge, the inventor has succeeded in obtaining a toner excellent in high-temperature preservability and positive chargeability by controlling a ring-opening rate of the oxazoline group in the resin (specifically, the specific copolymer) forming the shell layers. Specifically, when the amount of the ring unopened oxazoline group in the toner is at least 0.10 μmol/g and no greater than 100 μmol/g, the toner is excellent in high-temperature preservability, charge decay characteristic, and charge rise characteristic (see Tables 1 and 2 mentioned later). A charge rise characteristic of the toner can be improved by leaving the ring unopened oxazoline group (unreacted oxazoline group) in the specific copolymer by an appropriate amount. Heat resistance of the toner can be improved by cross-linking an appropriate amount of the oxazoline group of the specific copolymer. A toner excellent in charge decay characteristic can be obtained by controlling a ring opening reaction of the oxazoline group to allow the ring unopened oxazoline group to remain not so much in the specific copolymer. The ring unopened oxazoline group has high water-absorbability. Therefore, too much ring-opened oxazoline group remaining in the specific copolymer may impair charge stability of the toner.

Even in a configuration in which the toner cores contain a negatively chargeable resin (specific examples include a polyester resin and a styrene-acrylic acid-based resin), a charge decay characteristic of the toner having the aforementioned basic features can be improved. Note that it may be thought to be possible to improve positive chargeability of the toner particles through use of an amine compound as a positively chargeable charge control agent. However, it is difficult to form the toner particles in a situation in which a resin having a negative zeta potential (for example, a polyester resin) is used together with the amine compound having a positive zeta potential in water.

The following describes a suitable shell material.

In the above formula (1), $R^1$ represents a hydrogen atom or an optionally substituted linear, branched, or cyclic alkyl group. An example of a substituent in a configuration in which $R^1$ represents a substituted alkyl group is a phenyl group. A hydrogen atom, a methyl group, an ethyl group, or an isopropyl group is particularly preferable as $R^1$.

The specific copolymer includes a repeating unit derived from a vinyl compound other than the compound (1) (referred to below as other vinyl compound). At least one vinyl compound selected from the group consisting of a styrene-based monomer and an acrylic acid-based monomer is preferable as the other vinyl compound. Examples of a preferable styrene-based monomer include styrene, alkylstyrene (specific examples include α-methylstyrene, p-ethylstyrene, and 4-tert-butylstyrene), hydroxystyrene (specific examples include p-hydroxystyrene and m-hydroxystyrene), and halogenated styrene (specific examples include α-chlorostyrene, o-chlorostyrene, m-chlorostyrene, and p-chlorostyrene). Furthermore, examples of a preferable acrylic acid-based monomer include (meth)acrylic acid, (meth) acrylic acid alkyl ester, (meth)acrylic acid hydroxyalkyl ester, (meth)acrylic acid aryl ester, (meth)acrylonitrile, and (meth)acrylamide.

For example, in a configuration in which the other vinyl compound is an acrylic acid alkyl ester having an optionally substituted alkyl group, the acrylic acid alkyl ester becomes a repeating unit for example represented by the following formula (2) through addition polymerization to constitute a copolymer.

(2)

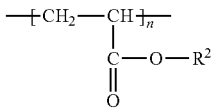

In formula (2), $R^2$ represents an optionally substituted linear, branched, or cyclic alkyl group. An alkyl group having a carbon number of at least 1 and no greater than 8 is preferable as the alkyl group. In a configuration in which $R^2$ represents a substituted alkyl group, a hydroxyl group is preferable as a substituent of the substituted alkyl group. Examples of preferable $R^2$ include a methyl group, an ethyl group, an n-propyl group, an iso-propyl group, an n-butyl group, an iso-butyl group, a 2-ethylhexyl group, a hydroxyethyl group, a hydroxypropyl group, and a hydroxybutyl group.

For example, in a configuration in which the other vinyl compound is an optionally substituted methacrylic acid alkyl ester, the optionally substituted methacrylic acid alkyl ester becomes a repeating unit for example represented by the following formula (3) through addition polymerization to constitute a copolymer.

(3)

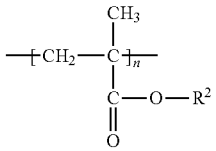

In formula (3), $R^3$ represents an optionally substituted linear, branched, or cyclic alkyl group. An alkyl group having a carbon number of at least 1 and no greater than 8 is preferable as the alkyl group. In a configuration in which $R^3$ represents a substituted alkyl group, a hydroxyl group is preferable as a substituent of the substituted alkyl group. Examples of preferable $R^3$ include a methyl group, an ethyl group, an n-propyl group, an iso-propyl group, an n-butyl group, an iso-butyl group, a 2-ethylhexyl group, hydroxyethyl group, a hydroxyethyl group, a hydroxypropyl group, and a hydroxybutyl group.

For example, in a configuration in which the other vinyl compound is a styrene-based monomer, the styrene-based monomer becomes a repeating unit for example represented by the following formula (4) through addition polymerization to constitute a copolymer.

(4)

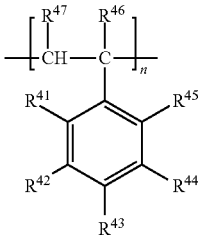

In formula (4), $R^{41}$ to $R^{47}$ each represent, independently of one another, a hydrogen atom or any substituent. Examples of preferable $R^{41}$ to $R^{45}$ include, each independently of one another, a halogen atom, a hydroxyl group, an optionally substituted alkyl group, and an optionally substituted aryl group. A halogen atom, a methyl group, an ethyl group, or a hydroxyl group is particularly preferable as $R^{41}$ to $R^{45}$ independently of one another. Examples of $R^{46}$ and $R^{47}$ include, each independently of one another, a hydrogen atom and a methyl group.

In order to improve high-temperature preservability of the toner, an external additive attached to the surfaces of toner mother particles preferably includes a powder of crosslinked resin particles having a glass transition point of at least 100° C. Hereinafter, a powder of crosslinked resin particles having a glass transition point of at least 100° C. may be referred to as a heat resistant resin powder. The crosslinked resin particles contained in the external additive preferably has a glass transition point of no greater than 150° C. in order to improve both high-temperature preservability and low-temperature fixability of the toner. Too high glass transition point of the crosslinked resin particles tends to impair low-temperature fixability of the toner.

In order to obtain a toner excellent in all of high-temperature preservability, low-temperature fixability, and fluidity, it is preferable that the external additive attached to the surfaces of the toner mother particles includes a heat resistant resin powder (powder of a crosslinked resin particles having a glass transition point of at least 100° C.) and an inorganic powder (powder of inorganic particles) and the heat resistant resin powder and the inorganic powder form a stacked structure of the heat resistant resin powder and the inorganic powder stacked in the stated order from the side of a toner mother particle.

Figure 2:
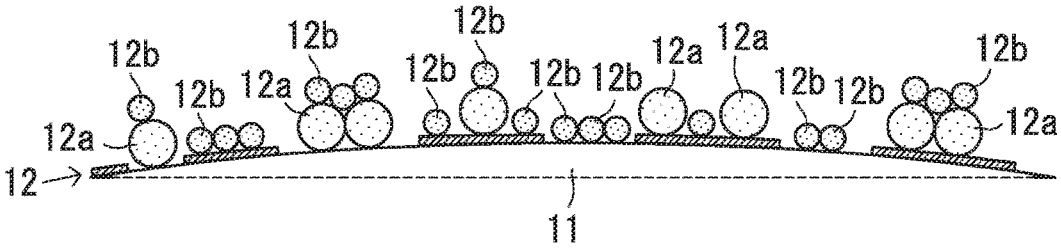
FIG. 2 is an enlarged view of a part of a surface of a toner particle in the electrostatic latent image developing toner according to the embodiment of the present disclosure.

The following describes one example of configuration of a toner particle of the toner having the aforementioned basic features with reference to FIGS. 1 and 2. FIG. 1 is a diagram illustrating one example of sectional structure of a toner mother particle include in the toner having the above basic features. FIG. 2 is a diagram illustrating one example of sectional structure of a toner particle having the aforementioned stacked structure (lower: heat resistant resin powder, upper: inorganic powder).

A toner mother particle 10 illustrated in FIG. 1 includes a toner core 11 and a shell layer 12 that partially covers a surface of the toner core 11. The toner core 11 is for example a pulverized core, which will be described later. When an external additive is attached to toner mother particles 10, toner particles containing the external additive are obtained. For example, when a powder of toner mother particles 10 and the external additive (specifically, a powder of external additive particles) are stirred together, the external additive particles are attached to the surfaces of the toner mother particles 10.

In the example illustrated in FIG. 2, the external additive attached to the surface of the toner mother particle 10 contains a heat resistant resin powder (a plurality of crosslinked resin particles 12*a*) and an inorganic powder (a plurality of inorganic particles 12*b*). The crosslinked resin particles 12*a* are particles of a crosslinked resin having a glass transition point of at least 100° C. The heat resistant resin powder (a plurality of the crosslinked resin particles 12*a*) and the inorganic powder (a plurality of inorganic particles 12*b*) are stacked in the order of the heat resistant resin powder (the plurality of crosslinked resin particles 12*a*) and the inorganic powder (the plurality of inorganic particles 12*b*) from the side of the toner mother particle 10. That is, all of the crosslinked resin particles 12*a* are located closer to the toner mother particle 10 than the inorganic particles 12*b*. Some crosslinked resin particles 12*a* are attached to the surface of the toner mother particle 10. Some inorganic particles 12*b* are attached to the surfaces of the crosslinked resin particles 12*a*. However, the inorganic particles 12*b* may be attached to the surface of the toner mother particle 10 in a surface region of the toner mother particle 10 in which no crosslinked resin particles 12*a* are present. Respective parts (bottom parts) of the crosslinked resin particles 12*a* may be embedded in a surface layer portion of the toner mother particle 10. The inorganic particles 12*b* located on the crosslinked resin particles 12*a* are thought to be attached to the crosslinked resin particles 12*a* predominantly by Van der Waals force.

Toner cores prepared by a dry method tend to be excellent in compatibility in terms of the shell layers defined by the aforementioned basic features and the aforementioned stacked structure (lower: heat resistant resin powder, upper: inorganic powder). Toner cores especially excellent in compatibility are pulverized cores obtained by a pulverization method. The pulverization method is a method for obtaining a powder (for example, toner cores) by two processes of melt-kneading plural materials (for example, a resin) to obtain a kneaded substance and pulverizing the resultant kneaded substance. Typically, toner cores are classified into pulverized cores (also called a pulverized toner) and polymerized cores (also called a polymerized toner) in a technical field to which the present invention belongs. The pulverized cores and the polymerized cores can be easily discriminated by observing shapes and states of the particle surfaces.

In order to obtain a toner excellent in all of high-temperature preservability, low-temperature fixability, and fluidity by forming the aforementioned stacked structure (lower: heat resistant resin powder, upper: inorganic powder) on the surfaces of the toner mother particles, the external additive attached to the surfaces of the toner mother particles preferably contains a heat resistant resin powder (lower part of the stacked structure) having a number average primary particle diameter of at least 70 nm and no greater than 95 nm and a silica particle powder (upper part of the stacked structure) having a number average primary particle diameter of at least 5 nm and no greater than 40 nm. In order to obtain a toner excellent in all of high-temperature preservability, low-temperature fixability, and fluidity, it is particularly preferable that the amount of the heat resistant resin powder is at least 0.5 parts by mass and no greater than 5.0 parts by mass relative to 100 parts by mass of the toner mother particles and the amount of the silica particle powder (inorganic powder) is at least 0.5 parts by mass and no greater than 5.0 parts by mass relative to 100 parts by mass of the toner mother particles.

In order to form a high-quality image using the toner, the toner preferably has a volume median diameter ($D_{50}$) of at least 3 μm and less than 10 μm.

In a configuration in which the toner particles contains no external additive or an external additive of the toner particles is inorganic particles only, the shell layers preferably cover at least 70% and no greater than 95% of the total surface area of the toner cores in order to improve both high-temperature preservability and low-temperature fixability of the toner. In a configuration in which the external additive of the toner particles contains a crosslinked resin particles having a glass transition point of at least 100° C., the shell layers preferably cover at least 70% and no greater than 80% of the total surface area of the toner cores in order to improve both high-temperature preservability and low-temperature fixability of the toner.

The following describes, in order, the toner cores (binder resin and internal additives), the shell layers, and the external additive. An unnecessary component may be omitted according to use of the toner.

[Toner Core]

(Binder Resin)

The binder resin is typically a main component (for example, at least 85% by mass) of the toner cores. Properties of the binder resin are therefore expected to have great influence on an overall property of the toner cores. A combinational use of a plurality of resins as the binder resin can result in adjustment of a property (specific examples include hydroxyl value, acid value, Tg, and Tm) of the binder resin. The toner cores have a strong tendency to be anionic when the binder resin has a group such as an ester group, a hydroxyl group, an ether group, an acid group, or a methyl group. By contrast, the toner cores have a strong tendency to be cationic when the binder resin has a group such as an amino group or an amide group. At least one of the hydroxyl value and the acid value of the binder resin is preferably at least 10 mgKOH/g in order to enhance bindability (reactivity) between the toner core and the shell layer.

Examples of a preferable binder resin of the toner cores include thermoplastic resins (specific examples include styrene-acrylic acid-based resin and polyester resin) with a polyester resin being particularly preferable.

A styrene-acrylic acid-based resin is a copolymer of for example at least one styrene-based monomer and at least one acrylic acid-based monomer. A polyester resin can be yielded by condensation polymerization of at least one polyhydric alcohol and at least one polybasic carboxylic acid.

Examples of alcohols that can be used for synthesis of a polyester resin include dihydric alcohols (specific examples include diols and bisphenols) and tri- or higher-hydric alcohols, as listed below. Examples of carboxylic acids that can be preferably used for synthesis of a polyester resin include dibasic carboxylic acids and tri- or higher-basic carboxylic acids, listed below.

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecandiol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adducts, and bisphenol A propylene oxide adducts.

Examples of preferable tri- or higher-hydric alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, digylcerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, sebacic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), and alkenylsuccinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Particularly preferably, the toner cores contain, as the binder resin, a condensation polymer (polyester resin) of at least one aliphatic diol having a carbon number of at least 2 and no greater than 4 (for example, propanediol) and at least one aromatic dibasic carboxylic acid (for example, terephthalic acid) in order to improve both high-temperature preservability and low-temperature fixability of the toner.

In a configuration in which a polyester resin is used as the binder resin of the toner cores, the polyester resin preferably has a number average molecular weight (Mn) of at least 1,000 and no greater than 2,000 in order to improve strength of the toner cores and fixability of the toner. The polyester resin preferably has a molecular weight distribution (ratio (Mw/Mn) of a mass average molecular weight (Mw) relative to a number average molecular weight (Mn)) of at least 9 an no greater than 21. Measurement of Mn and Mw of the polyester resin can be done using gel permeation chromatography.

The toner cores preferably have a glass transition point (Tg) of at least 20° C. and no greater than 55° C. in order to improve both high-temperature preservability and low-temperature fixability of the toner. The toner cores preferably have a softening point (Tm) of at least 70° C. and no greater than 105° C. in order to improve both high-temperature preservability and low-temperature fixability of the toner.

(Colorant)

The toner cores may each contain a colorant. The colorant can be a known pigment or dye that matches the color of the toner. The amount of the colorant is preferably at least 1 part by mass and no greater than 20 parts by mass relative to 100 parts by mass of the binder resin.

The toner cores may contain a black colorant. Carbon black can for example be used as a black colorant. Alternatively, a colorant that is adjusted to a black color using a yellow colorant, a magenta colorant, and a cyan colorant can for example be used as a black colorant.

The toner cores may contain a colorant such as a yellow colorant, a magenta colorant, and a cyan colorant.

One or more compounds selected from the group consisting of condensed azo compounds, isoindolinone compounds, anthraquinone compounds, azo metal complexes, methine compounds, and arylamide compounds can be used for example as a yellow colorant. Specific examples of yellow colorants that can be preferably used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow low and C. I. Vat Yellow.

One or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used for example as a magenta colorant. Specific examples of magenta colorants that can be preferably used include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

One or more compounds selected from the group consisting of copper phthalocyanine compounds, anthraquinone compounds, and basic dye lake compounds can be used for example as a cyan colorant. Specific examples of cyan colorants that can be preferably used include C. I. Pigment Blue (1, 7, 15, 15:1, 15:2, 15:3, 15:4, 60, 62, and 66), Phthalocyanine Blue, C. I. Vat Blue, and C. I. Acid Blue.

(Releasing Agent)

The toner cores may optionally contain a releasing agent. The releasing agent is for example used in order to improve fixability of the toner or resistance of the toner to being offset. The toner cores are preferably prepared using an anionic wax in order to increase anionic strength of the toner cores. The amount of the releasing agent is preferably at least 1 part by mass and no greater than 30 parts by mass relative to 100 parts by mass of the binder resin in order to improve fixability or offset resistance of the toner.

Examples of a releasing agent that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a part or all of a fatty acid ester has been deoxidized such as deoxidized carnauba wax. A single releasing agent may be used or a combination of two or more releasing agents may be used.

A compatibilizer may be added to the toner cores in order to improve compatibility between the binder resin and the releasing agent.

(Charge Control Agent)

The toner cores may optionally contain a charge control agent. The charge control agent is for example used in order to improve charge stability or a charge rise characteristic of the toner. The charge rise characteristic of the toner is an indicator as to whether or not the toner can be charged to a specific charge level in a short period of time.

Containment of a negatively chargeable charge control agent (specific examples include an organic metal complex and a chelate compound) in the toner cores can result in an increase in anionic strength of the toner cores. By contrast, containment of a positively chargeable charge control agent (specific examples include pyridine, nigrosine, and quaternary ammonium salt) in the toner cores can result in an increase in cationic strength of the toner cores. However, the toner cores need not to contain a charge control agent in a configuration in which sufficient chargeability of the toner can be ensured.

(Magnetic Powder)

The toner cores may optionally contain a magnetic powder. Examples of materials of the magnetic powder that can be preferably used include ferromagnetic metals (specific examples include iron, cobalt, nickel, and an alloy containing one or more of the listed metals), ferromagnetic metal oxides (specific examples include ferrite, magnetite, and chromium dioxide), and materials subjected to ferromagnetization (specific examples include carbon materials to which ferromagnetism is imparted through thermal treatment). A single magnetic powder may be used or a combination of two or more magnetic powders may be used. Furthermore, the magnetic powder is preferably subjected to surface treatment in order to inhibit elution of metal ions (e.g., iron ions) from the magnetic powder.

[Shell Layer]

The shell layers in the toner having the above basic features contain the specific copolymer (a copolymer of at least two vinyl compounds including a compound represented by the above formula (1)). Examples of monomers (vinyl compounds) that can be preferably used for synthesizing the resin (specific copolymer) forming the shell layers are those listed above (see formulas (1) to (4), for example). An example of a preferable specific copolymer that can be contained in the shell layers is a copolymer of monomers (resin materials) including at least one compound represented by the above formula (1) and at least one (meth) acrylic acid alkyl ester. For example, "EPOCROS (registered Japanese trademark) WS-300" manufactured by NIPPON SHOKUBAI CO., LTD. contains a copolymer (water soluble crosslinking agent) of methyl methacrylate and a compound (1) containing a hydrogen atom as $R^1$. The shell layers preferably contain a resin crosslinked by the oxazoline group in the compound (1). The oxazoline group tends to form cross-linking structure (eventually, three-dimensional mesh structure) in a resin, as described as above. Specifically, the oxazoline group tends to react with a carboxyl group to form an amide ester bond.

[External Additive]

An external additive (specifically, a powder containing a plurality of external additive particles) may be attached to the surfaces of the toner mother particles. Unlike the internal additive, the external additive is not present inside the toner mother particles and is selectively present only on the surfaces of the toner mother particles (surface layer portions of the toner particles). For example, stirring the toner mother particles (specifically, a powder containing a plurality of toner mother particles) and an external additive (specifically, a powder containing a plurality of external additive particles) together can cause the external additive particles to be attached to the surfaces of the toner mother particles. The toner mother particles and the external additive particles are bonded together physically rather than chemically without chemical reaction therebetween. Bonding strength between the toner mother particles and the external additive particles can be adjusted through adjustment of stirring conditions (specific examples include time period and rotational speed of stirring) and a particle diameter, a shape, and a surface state of the external additive particles.

A plurality of crosslinked resin particles (external additive particles) may be attached to the surfaces of the toner mother particles. The crosslinked resin particles are preferably bonded to the surfaces of the toner mother particles strongly in order to inhibit separation of the crosslinked resin particles from the toner particles. The crosslinked resin particles may be fixed to the surfaces of the toner mother particles through mechanical bonding by embedment. For example, in a configuration in which the crosslinked resin particles each have a large particle diameter, powerful stirring of the toner mother particles and the external additive can result in embedment of respective parts (bottom parts) of the crosslinked resin particles in the surface layer portions of the toner mother particles to fix the crosslinked resin particles to the surfaces of the toner mother particles. However, too large particle diameters of the crosslinked resin particles may make it difficult to fix the crosslinked resin particles to the surfaces of the toner mother particles. The crosslinked resin particles each preferably protrude from the surfaces of the toner mother particles at a length rate in a depth direction of at least 80% in order to inhibit attachment of the toner to for example a photosensitive member (or agglomeration of the toner). Protrusion of the crosslinked resin particles at a rate of at least 80% of a total length thereof in the depth direction (diameter in a spherical configuration) can allow the crosslinked resin particles to readily function as spacers between the toner particles and another member (for example, a photosensitive member) or between the toner particles. The protrusion rate of the respective crosslinked resin particles can be determined using a microscope.

Preferably, the external additive particles are weakly bonded to the toner mother particles (for example, spherically-shaped external additive particles each having a small diameter are attached to the surfaces of the toner mother particles in a rotatable manner) in order that the external additive particles enhance fluidity of the toner. It is thought that a configuration in which the external additive particles can move while rotating on the surfaces of the toner mother particles can enhance fluidity of the toner. The external additive particles that are used for enhancing fluidity of the toner are preferably attached to the surfaces of the toner mother particles predominantly by Van der Waals force or electrostatic force.

The crosslinked resin particles (external additive particles) preferably contain a crosslinked acrylic acid-based resin. The crosslinked acrylic acid-based resin is excellent in chargeability, and use of the crosslinked acrylic acid-based resin can facilitate preparation of particulates having uniform shape and dimension when compared to preparation thereof for example using a melamine resin. Furthermore, the crosslinked acrylic acid-based resin has excellent durability and charge stability.

The crosslinked acrylic acid-based resin is a polymer of a crosslinking agent and at least one acrylic acid-based monomer. The following acrylic acid-based monomers and crosslinking agents can be preferably used for example for synthesis of the crosslinked acrylic acid-based resin.

Examples of preferable acrylic acid-based monomers include (meth)acrylic acids, (meth)acrylonitrile, (meth) acrylic acid alkyl esters, and (meth)acrylic acid hydroxyalkyl esters. Examples of preferable (meth)acrylic acid alkyl esters include (meth)methyl acrylate, (meth)ethyl acrylate, (meth)n-propyl acrylate, (meth)iso-propyl acrylate, (meth) n-butyl acrylate, (meth)iso-butyl acrylate, and (meth)2-ethylhexyl acrylate. Examples of preferable (meth)acrylic acid hydroxyalkyl esters include (meth)2-hydroxyethyl acrylate, (meth)3-hydroxypropyl acrylate, (meth)2-hydroxypropyl acrylate, and (meth)4-hydroxybutyl acrylate.

A compound having at least two unsaturated bonds is preferable as the cross-linking agent. Examples of particularly preferable crosslinking agent include a monocyclic compound having at least two functional groups each having an unsaturated bond (specific examples include divinylbenzene) and a condensate of one polyhydric alcohol and at least two monovalent carboxylic acids each having a functional group having an unsaturated bond (specific examples include ethylene glycol dimethacrylate and butanediol dimethacrylate). Examples of the functional groups each having an unsaturated bond include a vinyl group ($CH_2$═CH—) and a substituted vinyl group.

When a cationic surfactant (for example, alkyl benzyl ammonium salt) is allowed to be present on the surfaces of the crosslinked resin particles, positive chargeability of the crosslinked resin particles can be increased.

Examples of inorganic particles (external additive particles) that can be preferably used include silica particles and particles of metal oxides (specific examples of the metal oxides include alumina, titanium oxide, magnesium oxide, zinc oxide, strontium titanate, and barium titanate). A single external additive may be used or a combination of two or more external additives may be used.

The external additive particles may be subjected to surface treatment. For example, in a configuration in which silica particles are used as the external additive particles, either or both hydrophobicity and positive chargeability may be imparted to the surfaces of the silica particles by surface treatment using a surface preparation agent. Examples of surface preparation agents that can be preferably used include coupling agents (specific examples include a silane coupling agent, a titanate coupling agent, and an alminate coupling agent), silazane compounds (examples include a chain silazane compound and a cyclic silazane compound), and silicone oils (specific examples include a dimethyl silicone oil). A silane coupling agent or a silazane compound is particularly preferable as the surface preparation agent. Examples of preferable silane coupling agents include silane compounds (specific examples include methyltrimethoxysilane and aminosilane). Examples of preferable silazane compounds include hexamethyldisilazane (HMDS). When the surfaces of silica base material (untreated silica particles) are treated using a surface preparation agent, many hydroxyl groups (—OH) present on the surfaces of the silica base material are partially or entirely substituted by a functional group derived from the surface preparation agent. Through the above, silica particles are yielded each having a surface on which the functional group derived from the surface preparation agent (specifically, a functional group having either or both stronger hydrophobicity and stronger positive chargeability than a hydroxyl group) is present.

[Toner Production Method]

The following describes an example of a method for producing a toner having the aforementioned basic features. First of all, toner cores are prepared. Subsequently, the toner cores and a shell material (for example, an oxazoline group containing water-soluble polymer) are added to a solvent. The shell material is then caused to react in the solvent to form shell layers substantially formed from a resin on the surfaces of the toner cores. Preferably, the shell layers are formed on the surfaces of the toner cores in a solvent containing either or both of a basic substance (specific examples include ammonia and sodium hydroxide) and a ring opening agent (specific examples include acetic acid) in order to produce the toner having the above basic features. Change in respective amounts of the basic substance and the ring opening agent can result in adjustment of the amount of the ring unopened oxazoline group contained in the toner. The larger the amount of the basic substance in the solvent is, the more the amount of the ring unopened oxazoline group tends to increase. Neutralization (trapping) of the carboxylic acid by the basic substance is thought to inhibit a ring-opening reaction of the oxazoline group (nucleophilic addition reaction toward the carbonyl group). In another aspect, the more the amount of the ring opening agent, which promotes a ring opening reaction of the oxazoline group, in the solvent is, the more the amount of the ring unopened oxazoline group tends to decrease.

It is preferable to dissolve or disperse the shell material in the solvent for example by stirring the solvent containing the shell material in order to form uniform shell layers. In order to inhibit dissolution or elution of toner core components (particularly, the binder resin and the releasing agent) during formation of the shell layers, the formation of the shell layers is preferably carried out in an aqueous medium. The aqueous medium is a medium of which main component is water (specific examples include pure water and a liquid mixture of water and a polar medium). The aqueous medium may function as a solvent. A solute may be dissolved in the aqueous medium. The aqueous medium may function as a dispersion medium. A dispersoid may be dispersed in the aqueous medium. Examples of polar mediums that can be used in the aqueous medium include alcohols (specific examples include methanol and ethanol). The aqueous medium has a boiling point of about 100° C.

The following describes a toner producing method in further detail by referring to more specific examples.

(Toner Core Preparation)

In order to easily prepare preferable toner cores, the toner cores are preferably produced by an aggregation method or a pulverization method and more preferably by the pulverization method.

An example of the pulverization method will be described below. First, a binder resin and an internal additive (for example, at least one of a colorant, a releasing agent, a charge control agent, and a magnetic powder) are mixed together. Subsequently, the resultant mixture is melt-knead. The resultant melt-knead substance is pulverized and then classified. As a result, toner cores having a desired particle size are produced.

An example of the aggregation method will be described below. Respective particulates of a binder resin, a releasing agent, and a colorant are aggregated in an aqueous medium to yield aggregated particles containing the binder resin, the releasing agent, and the colorant. The resultant aggregated particles are then heated to coalesce components contained in the aggregated particles. As a result, a toner core dispersion is obtained. Thereafter, unnecessary substances (for example, a surfactant) are removed from the toner core dispersion to produce toner cores.

(Shell Layer Formation)

Subsequently, the toner cores and a shell material (for example, an oxazoline group-containing polymer solution) are added to an aqueous medium (for example, ion exchanged water).

The shell material (for example, an oxazoline group-containing polymer dissolved in the aqueous medium) is attached to the surfaces of the toner cores in the aqueous medium. In a situation in which it is necessary to uniformly attach the shell material to the surfaces of the toner cores, it is preferable to highly disperse the toner cores in a solvent containing the shell material. In order to highly disperse the toner cores in the solvent, the solvent may contain a surfactant or be stirred using a high-power stirrer (for example, "Hivis Disper Mix" manufactured by PRIMIX Corporation).

Then, a basic substance (for example, an aqueous ammonium solution) is further added to the aqueous medium. Control of the additive amount of the basic substance can result in adjustment of the amount of ring unopened oxazoline group contained in the toner. Furthermore, a ring opening agent (for example, acetic acid) may be added in addition. Control of the additive amount of the ring opening agent can result in adjustment of the amount of the ring unopened oxazoline group contained in the toner.

The solvent containing for example the shell material is then heated up to a predetermined retention temperature (for example, at least 50° C. and no greater than 85° C.) at a specific rate (for example, at least 0.1° C./min. and no greater than 3° C./min.) while being stirred. The temperature of the solvent is kept at the predetermined retention temperature for a specific time period (for example, at least 30 minutes and no greater than four hours), while the liquid is stirred. A reaction between the toner cores and the shell material (solidification of shell layers) is thought to proceed during the solvent being kept at high temperature (or being increased in temperature). For example, the oxazoline group in the shell material reacts with a functional group present on the surface of the binder resin forming the toner cores to be ring-opened, thereby forming cross-linking structure. Bonding of the shell material to the toner cores forms the shell layers. When the shell layers are formed on the surfaces of the toner cores in the solvent, a dispersion of toner mother particles is obtained.

After formation of the shell layers, the dispersion of the toner mother particles is neutralized for example using sodium hydroxide. The dispersion of the toner mother particles is subsequently cooled for example to normal temperature (about 25° C.). The cooled dispersion of the toner mother particles is filtered for example using a Buchner funnel. Through the above, the toner mother particles are separated from the solvent (solid-liquid separation), thereby obtaining a wet cake of the toner mother particles.

Subsequently, the toner mother particles were washed. The washed toner mother particles are then dried. Thereafter, as needed, the toner mother particles may be mixed with an external additive using a mixer (for example, an FM mixer manufactured by Nippon Coke & Engineering Co., Ltd.) to attach the external additive to the surfaces of the toner mother particles. Note that in a situation in which a spray dryer is used in the drying process, the drying process and the external additive addition process can be carried out simultaneously by spraying a dispersion of an external additive (for example, silica particles) to the toner mother particles. Through the above, a toner containing multiple toner particles are produced.

In a situation in which the aforementioned stacked structure (lower: heat resistant resin powder, upper: inorganic powder) is formed on the surfaces of the toner mother particles, a plurality of crosslinked resin particles (a powder) can be attached to the surfaces of the toner mother particles (a powder) by mixing the toner mother particles with the crosslinked resin particles using a FM mixer (product of Nippon Coke & Engineering Co., Ltd.). Toner mother particles each having a surface to which crosslinked resin particles are attached are referred to below as first external added toner mother particles. Subsequently, the aforementioned stacked structure (lower: heat resistant resin powder, upper: inorganic particles) can be formed on the surfaces of the toner mother particles by mixing the first external added toner mother particles (a powder) with the inorganic particles (a powder) for example using an FM mixer (product of Nippon Coke & Engineering Co., Ltd.).

The FM mixer includes a mixing tank equipped with a temperature adjusting jacket and further includes, in the mixing tank, a deflector, a temperature sensor, an upper vane, and a lower vane. When the FM mixer mixes a martial (specifically, a powder or a slurry) charged into the mixing tank, the material in the mixing tank flows in the up-and-down direction while being circulated by rotation of the lower vane. This causes a convection current of the material in the mixing tank. The upper vane is rotated at high speed to apply shear force to the material. The FM mixer is capable of mixing the material by high mixing power through application of the shear force to the material.

The details and sequence of the above toner producing method may be changed freely as appropriate in accordance with requirements of the toner, such as in terms of composition and properties. For example, the shell material and the toner cores may be added to the solvent at the same time or the toner cores may be added to the solvent prior to or after dissolution of the shell material in the solvent. Also, the shell material may be added to the solvent as a single addition or may be divided up and added to the solvent as a plurality of additions. In a situation in which a material (for example, the shell material) is caused to react in the solvent, the material may be caused to react in the solvent for a predetermined time period after being added to the solvent. Alternatively, the material may be caused to react in the solvent while the material is added to the solvent over a long period of time. Furthermore, the toner may be sifted after the external additive addition process. In addition, a non-essential process may of course be omitted. For example, in a situation in which a commercially available product can be directly used as a material, use of the commercially available product can result in omission of preparation of the material. In a situation in which an external additive needs not to be attached to the surfaces of the toner mother particles (the external additive addition process is omitted), the toner mother particles are equivalent to toner particles. In a situation in which a resin is synthesized, a monomer or a prepolymer may be used as a material for the resin synthesis. For yielding a specific compound, a salt of the compound, ester, an anhydride, or a hydrate may be used as a material thereof. Respective materials may be used in a solid state or a liquid state. For example, a material of a powder in a solid state may be used. Alternatively, a solution of the material (material in a liquid state dissolved in a solvent) or a dispersion of the material (material dispersed rather than dissolved in a solvent) may be used. Preferably, a large number of toner particles are formed simultaneously in order to produce the toner efficiently. The toner particles produced at the same time are thought to have substantially the same configuration.

Examples

The following describes, in order, production methods, evaluation methods, and evaluation results for toners (electrostatic latent image developing toners) according to examples and comparative examples. In evaluations in which errors may occur, an evaluation value was calculated by calculating the arithmetic mean of an appropriate number of measured values in order to ensure that any error was sufficiently small.

First Evaluation

Toners TA-1 to TA-8 indicated in Table 1, which each are an electrostatic latent image developing toner, were evaluated in first evaluation.

TABLE 1

| | Additive amount (shell layer formation process) | | | |
|---|---|---|---|---|
| Toner | Oxazoline group-containing polymer (% by mass) | Aqueous ammonium solution [mL] | Acetic acid [mL] | Ring unopened oxazoline group [μmol/g] |
| TA-1 | 1 | 6 | 0 | 0.16 |
| TA-2 | 2 | 6 | 0 | 8.00 |
| TA-3 | 3 | 6 | 0 | 29.0 |
| TA-4 | 5 | 6 | 0 | 72.0 |
| TA-5 | 7 | 6 | 2 | 88.0 |
| TA-6 | 0 | 0 | 0 | 0.00 |
| TA-7 | 5 | 1 | 5 | 0.05 |
| TA-8 | 7 | 12 | 0 | 120 |

[Toner Production Method]

(Preparation of Toner Cores)

A 5-L reaction vessel equipped with a thermometer (thermocouple), a dewatering conduit, a nitrogen inlet tube, a rectifying column, and a stirrer was set in an oil bath, and 1,200 g of propanediol, 1,700 g of terephthalic acid, and 3 g of esterified catalyst (tin(II) 2-ethylhexanoate) were charged into the vessel. Subsequently, the internal temperature of the vessel was increased to 230° C. using the oil bath to cause a reaction (specifically a condensation reaction) of the vessel content for 15 hours in a nitrogen atmosphere at a temperature of 230° C. The pressure in the vessel was then reduced, and a reaction of the vessel content was caused in a depressurized atmosphere (pressure 8.0 kPa) at a temperature of 230° C. until a reaction product (polyester resin) had a Tm of a specific temperature (90° C.). As a result, a polyester resin having a Tm of 90° C. was yielded.

An FM mixer ("FM-20B" manufactured by Nippon Coke & Engineering Co., Ltd.) was used to mix 80 parts by mass of a binder resin (the polyester resin yielded as above), 9 parts by mass of a releasing agent (ester wax having a melting point of 73° C.: "NISSAN ELECTOR (registered Japanese trademark) WEP-3" manufactured by NOF Corporation), and 9 parts by mass of carbon black ("MA100" manufactured by Mitsubishi Chemical Corporation) for four minutes at a rotational speed of 2,000 rpm.

The resultant mixture was then melt-knead using a two-axis extruder ("PCM-30" manufactured by Ikegai Corp.) under conditions of a shaft rotational speed of 150 rpm, a set temperature range (cylinder temperature) of 100° C., and a processing speed of 100 g/min. Subsequently, the resultant melt-knead substance was cooled. The cooled melt-knead substance was coarsely pulverized to have a set particle diameter of 2 mm using a pulverizer ("Rotoplex (registered Japanese trademark)" manufactured by Hosokawa Micron Corporation). The resultant coarsely pulverized substance was finely pulverized using a pulverizer ("Turbo Mill Type RS" manufactured by FREUND-TURBO CORPORATION). The resultant finely pulverized substance was classified using a classifier ("Elbow Jet Type EJ-LABO" manufactured by Nittetsu Mining Co., Ltd.). As a result, toner cores having a volume median diameter ($D_{50}$) of 6.7 μm, Tm of 90° C., and Tg of 49° C. were prepared.

A description will be made next about a shell layer formation process. Note that the following shell layer formation process was not performed in production of the toner TA-6. The toner cores of the toner TA-6 are equivalent to toner mother particles.

(Shell Layer Formation Process)

A 1-L three-necked flask equipped with a thermometer and a stirring impeller was set in a water bath, and 300 g of ion exchanged water was charged into the flask. The internal temperature of the flask was then kept at 30° C. using the water bath. An oxazoline group-containing polymer solution ("EPOCROS WS-300" manufactured by NIPPON SHOKUBAI CO., LTD., solid concentration: 10% by mass, Tg: 90° C.) in an amount listed in Table 1 was added to the flask, and then, the flask content was stirred sufficiently. The amounts listed in Table 1 each indicate a ratio (unit: % by mass) of the oxazoline group-containing resin relative to toner cores (300 g) that were to be added later. For example, 30 g of the oxazoline group-containing polymer solution (EPOCROS WS-300) was added in production of the toner TA-1. The additive amount (30 g) is calculated as follows: "(amount of toner cores (300 g))×(amount listed in Table 1 (0.01))/(solid concentration (0.1))=30 g".

Subsequently, 300 g of the toner cores prepared through the above process was added to the flask and the flask content was stirred at a rotational speed of 200 rpm for one hour. Thereafter, 300 g of ion exchanged water was added to the flask.

An aqueous ammonium solution at a concentration of 1% by mass and an acetic acid at a concentration of 99% by mass were added to the flask by the respective amounts listed in Table 1. For example, 6 mL of an aqueous ammonium solution was added and no acetic acid was added to the flask in production of the toner TA-1. In production of the toner TA-5, 6 mL of the aqueous ammonium solution and 2 mL of the acetic acid were added to the flask.

Thereafter, the internal temperature of the flask was increased up to 60° C. at a rate of 0.5° C./min. while the flask content was stirred at a rotational speed of 150 rpm. Subsequently, the temperature (60° C.) was kept for one hour while the flask content was stirred at a rotational speed of 100 rpm.

An aqueous ammonium solution at a concentration of 1% by mass was then added to the flask to adjust the pH of the flask content to 7. The flask content was then cooled to normal temperature (about 25° C.) to obtain a dispersion containing toner mother particles.

(Washing Process)

The dispersion of the toner mother particles obtained as above was filtered (solid-liquid separated) using a Buchner funnel to obtain a wet cake of the toner mother particles. The obtained wet cake of the toner mother particles was re-dispersed in ion exchanged water. Dispersion and filtration were further repeated five times to wash the toner mother particles.

(Drying Process)

Thereafter, the resultant toner mother particles were dispersed in an ethanol solution at a concentration of 50% by mass. Through the above, a slurry of the toner mother particles was obtained. The toner mother particles in the slurry were then dried using a continuous surface-modifying apparatus ("Coatmizer (registered Japanese trademark)" manufactured by Freund Corporation) under conditions of a hot wind temperature of 45° C. and a flow rate of 2 $m^3$/min. As a result, a powder of the toner mother particles was yielded.

(External Additive Addition Process)

Subsequently, the yielded toner mother particles were subjected to external additive addition. Specifically, a 10-L FM mixer (product by Nippon Coke & Engineering Co., Ltd.) was used to mix 100 parts by mass of the toner mother particles and 1 parts by mass of positively chargeable silica particulates ("AEROSIL (registered Japanese trademark) REA90" manufactured by Nippon Aerosil Co., Ltd., content: dry silica particles to which positive chargeability has been imparted by surface treatment, number average primary particle diameter: 20 nm) for five minutes to attach an external additive (silica particles) to the surfaces of the toner mother particles. A resultant powder was sifted using a 200-mesh (opening size 75 μm) sieve. As a result, a toner (toners TA-1 to TA-8) including multiple toner particles was obtained.

The amount of ring unopened oxazoline group in each of the produced toners TA-1 to TA-8 was measured. Specifically, quantitative analysis adopting a gas chromatography mass spectrometry (GC-MS) method was carried out using a calibration curve (calibration curve based on a reference material) under the following conditions. The measurement results are indicated in Table 1. For example, the amount of the ring unopened oxazoline group was 0.16 μmol relative to 1 g of the toner TA-1.

<GC-MS Method>

A gas chromatograph mass spectrometer ("GCMS-QP 2010 Ultra" manufactured by Shimadzu Corporation) and a multi-shot pyrolizer ("FRONTIER LAB Multi-functional Pyrolyzer (registered Japanese trademark) PY-3030D" manufactured by Frontier Laboratories Ltd.) were used as measuring devices. A column that was used was a GC column ("Agilent (registered Japanese trademark) J&W Ultra-inert Capillary GC Column DB-5 ms" manufactured by Agilent Technologies Japan, Ltd., phase: allylene phase having a polymer main chain strengthened by introducing allyrene to siloxane, inner diameter: 0.25 mm, film thickness: 0.25 μm, length: 30 m).

(Gas Chromatography)

Carrier gas: helium (He) gas.

Charrier flow rate: 1 mL/min.

Vaporizing chamber temperature: 210° C.

Thermal decomposition temperature: heating furnace "600° C.", interface portion "320° C.".

Heating condition: after being kept at 40° C. for three minutes, temperature was raised up to 320° C. from 40° C. at a heating rate of 10° C./min. and then kept at 320° C. for 15 minutes.

(Mass Analysis)

Ionizing method: electron impact (EI) method.

Ion source temperature: 200° C.

Temperature of interface portion: 320° C.

Detection mode: scan (measurement range: 45 m/z to 500 m/z).

[Evaluation Methods]

Methods for evaluating respective samples (toners TA-1 to TA-8) are as follows.

(High-Temperature Preservability)

A 20-mL polyethylene container was charged with 2 g of a sample (toner) and left still in a thermostatic oven set at 58° C. for three hours. Thereafter, the container was taken out from the thermostatic oven to obtain an evaluation toner in the container.

The resultant evaluation toner was put on a 100-mesh (opening 150 μm) sieve. The mass of the toner prior to sifting was calculated by measuring the total mass of the sieve and the evaluation toner thereon. Next, the sieve was placed in a powder tester (product of Hosokawa Micron Corporation) and the evaluation toner was sifted in accordance with a manual of the powder tester by shaking the sieve for 30 seconds at a rheostat level of 5. After the sifting, the mass of toner left on the sieve was calculated by measuring the total mass of the sieve and the evaluation toner thereon (toner not passing through the sieve). An agglomeration (unit: % by mass) was calculated based on the following equation from the mass of the toner prior to sifting and the mass of the toner after sifting (mass of the toner remaining on the sieve after sifting).

$$\text{Agglomeration}=100\times(\text{mass of toner after sifting})/(\text{mass of toner prior to sifting})$$

An agglomeration of less than 10% by mass was evaluated as good, and an agglomeration of at least 10% by mass was evaluated as poor.

(Charge Decay Characteristic)

A charge decay constant α of each sample (toner) was measured by a method in accordance with JIS C 61340-2-1-2006 using an electrostatic dissipation measuring device ("NS-D100" manufactured by Nano Seeds Corporation). The following describes in detail the method for measuring a charge decay constant of a toner.

The sample (toner) was set in a measurement cell. The measurement cell was a metal cell with a recess having an inner diameter of 10 mm and a depth of 1 ram. The sample was loaded into the recess of the measurement cell, pressing on the sample from above using slide glass. Any of the sample that overflowed from the cell was removed by moving the slide glass back and forth on the surface of the cell. At least 0.04 g and no greater than 0.06 g of the sample was loaded into the cell.

Next, the measurement cell having the sample (toner) loaded therein was left in ambient conditions of 32° C. and 80% relative humidity for 12 hours. The grounded measurement cell was subsequently placed in the electrostatic dissipation measuring device in the ambient conditions of 32° C. and 80% relative humidity, and ions were supplied to the sample by corona discharge to charge the sample. The electrostatic dissipation measuring device was set to have a probe gap of 1 mm, and the sample was charged for 0.5 seconds. The surface potential of the sample was measured continuously starting from 0.7 seconds after completion of the corona discharge under a condition of a sampling frequency of 1 Hz. A charge decay constant (charge decay rate) α was calculated based on the measured surface potential and an equation "$V=V_0\exp(-\alpha\sqrt{t})$". In the equation: V represents a surface potential [V]; $V_0$ represents an initial surface potential [V]; and t represents a charge decay period [second].

A charge decay constant of less than 0.030 was evaluated as good, and a charge decay constant of at least 0.030 was evaluated as poor.

(Preparation of Evaluation Developer)

In ambient conditions of 25° C. and 50% relative humidity, 100 parts by mass of a developer carrier (carrier for "TASKalfa7551ci" manufactured by KYOCERA Document Solutions Inc.) and 8 parts by mass of a sample (toner) were mixed for 30 minutes using a mixer ("TURBULA (registered Japanese trademark) mixer" manufactured by Willy A. Bachofen AG (WAB)) to yield an evaluation developer (two-component developer).

(Charge Rise Characteristic)

Directly after preparation of the evaluation developer, a charge of the toner in the evaluation developer was measured using a Q/m meter ("MODEL 210HS-1" manufactured by TREK, INC.) under the following conditions.

<Method for Measuring Charge of Toner in Developer>

A measurement cell of the Q/m meter was charged with 0.10 g of a measurement target (developer: toner and carrier), and only the toner in the charged developer was sucked through a sieve (metal mesh) for ten seconds. The charge (unit: μC/g) of the toner in the developer was calculated based on an equation "(total charge (unit: μC) of sucked toner)/(mass (unit: g) of sucked toner)".

A charge measured as above of at least 20 μC/g was evaluated as good, and a charge measured as above of no greater than 20 μC/g was evaluated as poor.

(Low-Temperature Fixability)

Fixability was evaluated using a color printer ("FS-C5250DN" manufactured by KYOCERA Document Solutions Inc., modified to enable adjustment of fixing temperature) having a roller-roller type heat-pressure fixing section (nip width 8 mm) as an evaluation apparatus. The evaluation developer prepared through the above process was loaded into a developing device of the evaluation apparatus, and a sample (toner for replenishment use) was loaded into a toner container of the evaluation apparatus.

A solid image (specifically, an unfixed toner image) having a size of 25 mm by 25 mm was formed on paper having a basis weight of 90 g/m$^2$ (A4-size evaluation paper) in ambient conditions of 25° C. and 50% relative humidity using the evaluation apparatus under conditions of a linear velocity of 200 mm/sec. and a toner applied amount of 1.0 mg/cm$^2$. Next, the paper having the image formed thereon was passed through the fixing section of the evaluation apparatus.

A minimum fixing temperature of the toner was measured in a fixing temperature range of at least 100° C. and no greater than 200° C. Specifically, a minimum temperature at which the solid image (toner image) was fixable to the paper (i.e., a minimum fixing temperature) was measured by increasing the fixing temperature of the fixing section from 100° C. in increments of 1° C. Fixing of the toner was confirmed by a folding and rubbing test such as described below. Specifically, the fold and rubbing test was performed by folding the paper in half such that a surface on which the image was formed was folded inwards, and by rubbing a 1-kg weight covered with cloth back and forth on the fold five times. Next, the paper was opened up and a fold portion of the paper (i.e., a portion to which the solid image was fixed) was observed. The length of toner peeling of the fold portion (peeling length) was measure. The minimum fixing temperature was determined to be the lowest temperature among temperatures for which the peeling length was no greater than 1 mm. A minimum fixing temperature of less than 130° C. was evaluated as good, and a minimum fixing temperature of at least 130° C. was evaluated as poor.

[Evaluation Results]

Table 2 indicates evaluation results (high-temperature preservability: agglomeration, charge rise characteristic: charge rise constant, charge decay characteristic: charge decay constant, low-temperature fixability: minimum fixing temperature) for the toners TA-1 to TA-8.

TABLE 2

| | Toner | High-temperature preservability [% by mass] | Low-temperature fixability [° C.] | Charge: Rise characteristic [μC/g] | Charge: Decay characteristic |
|---|---|---|---|---|---|
| Example 1 | TA-1 | 8 | 122 | 20 | 0.018 |
| Example 2 | TA-2 | 7 | 123 | 21 | 0.019 |
| Example 3 | TA-3 | 4 | 124 | 23 | 0.021 |
| Example 4 | TA-4 | 2 | 126 | 30 | 0.024 |
| Example 5 | TA-5 | 1 | 128 | 32 | 0.028 |
| Comparative Example 1 | TA-6 | 18 (poor) | 118 | 3 (poor) | 0.016 |
| Comparative Example 2 | TA-7 | 3 | 126 | 9 (poor) | 0.016 |
| Comparative Example 3 | TA-8 | 1 | 128 | 38 | 0.035 (poor) |

The toners TA-1 to TA-5 (toners of Examples 1 to 5) each had the aforementioned basic features. Specifically, the toners TA-1 to TA-5 each included shell layers containing a copolymer of at least two vinyl compounds including a compound represented by the above formula (1) (specifically, a copolymer of methyl methacrylate and a compound (1) containing a hydrogen atom as $R^1$). As indicated in Table 1, the toners each contained a ring unopened oxazoline group in an amount of at least 0.10 μmol/g and no greater than 100 μmol/g. As indicated in Table 2, the toners TA-1 to TA-5 each were excellent in high-temperature preservability, charge rise characteristic, charge decay characteristic, and low-temperature fixability.

Image analysis on SEM images of toner particles found that the shell layers covered at least 70% and no greater than 80% of a total surface area of the toner cores in each of the toners TA-1 to TA-5.

When a styrene-based monomer (for example, styrene) is added in addition to the oxazoline group-containing polymer solution (EPOCROS WS-300) in the shell layer formation process in production of the toner TA-1, the shell layers contain a copolymer of methyl methacrylate, the styrene-based monomer, and the compound (1) containing a hydrogen atom as $R^1$. A toner having characteristics equivalent to those of the toner TA-1 can be produced even by the production method as above.

Second Evaluation

Toners TB-1 to TB-14 listed in Table 3, which each are an electrostatic latent image developing toner, were evaluated in second evaluation.

TABLE 3

| Toner | Resin particles (External additive): Type | Resin particles (External additive): Tg [° C.] | Ring unopened oxazoline group [μmol/g] |
|---|---|---|---|
| TB-1 | A | 114 | 0.16 |
| TB-2 | A | 114 | 8.00 |
| TB-3 | A | 114 | 29.0 |
| TB-4 | A | 114 | 72.0 |
| TB-5 | A | 114 | 88.0 |
| TB-6 | B | 130 | 0.16 |
| TB-7 | B | 130 | 8.00 |
| TB-8 | B | 130 | 29.0 |
| TB-9 | B | 130 | 72.0 |
| TB-10 | B | 130 | 88.0 |

TABLE 3-continued

| Toner | Resin particles (External additive): Type | Resin particles (External additive): Tg [° C.] | Ring unopened oxazoline group [μmol/g] |
|---|---|---|---|
| TB-11 | C | 91 | 0.16 |
| TB-12 | A | 114 | 0.00 |
| TB-13 | A | 114 | 120 |
| TB-14 | A | 114 | 0.05 |

[External Additive: Preparation of Resin Particles]

(Preparation of Crosslinked Resin Particles A)

A 3-L flask equipped with a stirrer, a nitrogen inlet tube, a thermometer, and a condenser (heat exchanger) was charged with 1,000 g of ion exchanged water and 4 g of a cationic surfactant ("Texnol (registered Japanese trademark) R5" manufactured by NIPPON NYUKAZAI CO., LTD., component: alkyl benzyl ammonium salt), and nitrogen substitution was performed for 30 minutes. Alkyl benzyl ammonium salt is thought to function as an emulsifier.

Subsequently, 2 g of potassium peroxodisulfate added to the flask was dissolved while the flask content was stirred. The flask content was then heated to 80° C. while being stirred in a nitrogen atmosphere. Once the temperature of the flask content reached 80° C., dripping of a mixture of 250 g of methyl methacrylate and 4 g of 1,4-butanediol dimethacrylate into the flask was started. The mixture was dripped overall over two hours while the flask content was stirred at a rotational speed of 300 rpm. After completion of the dripping, the flask content was stirred for additional eight hours while being kept at 80° C. The flask content was then cooled to normal temperature (about 25° C.) to obtain an emulsion of crosslinked resin particles. Subsequently, the resultant emulsion was dried to yield crosslinked resin particles A (a powder). The yielded crosslinked resin particles A had a number average particle diameter of 84 nm and a glass transition point (Tg) of 114° C. The cationic surfactant (alkyl benzyl ammonium salt) was attached to the surfaces of the crosslinked resin particles A.

(Preparation of Crosslinked Resin Particles B)

Crosslinked resin particles B were prepared according to the same method as that for the crosslinked resin particles A other than that 5 g of ethylene glycol dimethacrylate was used instead of 4 g of 1,4-butanediol dimethacrylate. The prepared crosslinked resin particles B had a number average particle diameter of 90 nm and a glass transition point (Tg) of 130° C. The cationic surfactant (alkyl benzyl ammonium salt) was attached to the surfaces of the crosslinked resin particles B.

(Preparation of Crosslinked Resin Particles C)

Crosslinked resin particles C were prepared according to the same method as that for the crosslinked resin particles B other than that the additive amount of ethylene glycol dimethacrylate was changed from 5 g to 1 g. The prepared crosslinked resin particles C had a number average particle diameter of 81 nm and a glass transition point (Tg) of 91° C. The cationic surfactant (alkyl benzyl ammonium salt) was attached to the surfaces of the crosslinked resin particles C.

[Methods for Producing Toners TB-1 to TB14]

The respective toners TB-1, TB-6, and TB-11 were produced according to the same method as for the toner TA-1 other than that the external additive addition process after preparation of the toner mother particles (powder) was changed to the followings.

The respective toners TB-2 and TB-7 were prepared according to the same method as for the toner TA-2 other than that the external additive addition process after preparation of the toner mother particles (a powder) was changed to the followings.

The respective toners TB-3 and TB-8 were produced according to the same method as for the toner TA-3 other than that the external additive addition process after preparation of the toner mother particles (a powder) was changed to the followings.

The respective toners TB-4 and TB-9 were produced according to the same method as for the toner TA-4 other than that the external additive addition process after preparation of the toner mother particles (a powder) was changed to the followings.

The respective toners TB-5 and TB-10 were produced according to the same method as for the toner TA-5 other than that the external additive addition process after preparation of the toner mother particles (a powder) was changed to the followings.

The toner TB-12 was produced according to the same method as for the toner TA-6 other than that the external additive addition process after preparation of the toner mother particles (a powder) was changed to the following.

The toner TB-13 was produced according to the same method as for the toner TA-8 other than that the external additive addition process after preparation of the toner mother particles (a powder) was changed to the following.

The toner TB-14 was produced according to the same method as for the toner TA-7 other than that the external additive addition process after preparation of the toner mother particles (a powder) was changed to the following.

(External Additive Addition Process)

A 10-L, FM mixer (product of Nippon Coke & Engineering Co., Ltd.) was used to mix 100 parts by mass of the toner mother particles and 1.25 parts by mass of crosslinked resin particles indicated in the column "Resin particle (External additive)" of Table 3 (any of the crosslinked resin particles A to C according to the respective toners) for one minute. Through the above mixing, first external added toner mother particles (toner mother particles having surfaces to which the crosslinked resin particles are attached) were obtained. Subsequently, a 10-L FM mixer (product of Nippon Coke & Engineering Co., Ltd.) was used to mix 101.25 parts by mass (=100 parts by mass plus 1.25 parts by mass) of the first external added toner mother particles, 1 parts by mass of positively chargeable silica particulates ("AEROSIL REA90" manufactured by Nippon Aerosil Co., Ltd., content: dry silica particles to which positive chargeability was imparted by surface treatment, number average primary particle diameter: 20 nm), and 0.5 parts by mass of conductive titanium oxide particles ("EC-100" manufactured by Titan Kogyo, Ltd., base: $TiO_2$ particles, coat layer: Sb-doped $SnO_2$ film, number average primary particle diameter: about 0.35 μm) for five minutes, thereby attaching the external additive (silica particles and titanium oxide particles) to the surfaces of the toner mother particles. Thereafter, the resultant powder was sifted using a 200-mesh (opening 75 μm) sieve. As a result, a toner (any of the toners TB-1 to TB-14) containing multiple toner particles was produced.

The toners TB-1 to TB-14 produced as above each contained a ring unopened oxazoline group in an amount listed in Table 3 (measuring method: the same as that in the first evaluation). For example, the amount of the ring unopened oxazoline group was 0.16 μmol relative to 1 g of the toner TB-1.

[Evaluation Methods]

The followings are evaluation methods for the samples (toners TB-1 to TB-14).

(High-Temperature Preservability)

High-temperature preservabilities of the toners were evaluated according to the same method as that in the first evaluation other than that the temperature set for the thermostatic oven was changed from 58° C. to 60° C. A measured agglomeration of no greater than 25% by mass was evaluated as good and a measured agglomeration of greater than 25% by mass was evaluated as poor.

(Low-Temperature Fixability)

Low-temperature fixabilities of the toners were evaluated according to the same method as that in the first evaluation. A measured minimum fixing temperature of less than 130° C. was evaluated as good and a measured minimum fixing temperature of at least 130° C. was evaluated as poor.

(Charge Rise Characteristic)

Charge rise characteristics of the toners were evaluated according to the same method as that in the first evaluation. A charge measured as above of at least 20 μC/g was evaluated as good, and a charge measured as above of less than 20 μC/g was evaluated as poor.

(Charge Decay Characteristic)

Charge decay characteristics of the toners were evaluated according to the same method as that in the first evaluation. A measured charge decay constant of less than 0.030 was evaluated as good, and a measured charge decay constant of at least 0.030 was evaluated as poor.

(Charge Change)

In ambient conditions of 25° C. and 50% relative humidity, 100 parts by mass of a developer carrier (carrier for "TASKalfa7551ci" manufactured by KYOCERA Document Solutions Inc.) and 8 parts by mass of a sample (toner) were mixed for 30 minute using a mixer ("TURBULA (registered Japanese trademark) mixer" manufactured by Willy A. Bachofen AG (WAB)) to yield an evaluation developer (two-component developer).

A multifunction peripheral ("TASKalfa7551ci" manufacture by KYOCERA Document Solutions Inc.) was used as an evaluation apparatus. The evaluation developer prepared through the above process was loaded into a developing device of the evaluation apparatus, and the sample (toner for replenishment use) was loaded into a toner container of the evaluation apparatus.

A first printing durability test was carried out in ambient conditions of 25° C. and 50% relative humidity using the above evaluation apparatus. The first printing durability test was printing of a sample image having a printing rate of 8% on 10,000 successive sheets of a recording medium (printing paper). After the first printing durability test, the developing device was taken out from the evaluation apparatus and the two-component developer was taken out from the developing device. The charge (also referred to below as charge $Q_{10,000}$) of the toner contained in the two-component developer was then measured. After the measurement of the charge $Q_{10,000}$, the taken developing device was re-fitted into the evaluation apparatus and a second printing durability test was carried out in ambient conditions of 25° C. and 50% relative humidity using the evaluation apparatus. The second printing durability test was printing of a sample image having a printing rate of 8% on 90,000 successive sheets of a recording medium (printing paper). After the second printing durability test, the developing device was taken out from the evaluation apparatus and the two-component developer was taken out from the developing device. The charge (also referred to below as charge $Q_{100,000}$) of the toner contained in the two-component developer was then measured. A charge change represented by the following equation, that is, a difference (absolute value) between the charge $Q_{10,000}$ and the charge $Q_{100,000}$ was calculated.

$$(\text{Charge change})=|(\text{charge } Q_{10,000})-(\text{charge } Q_{100,000})|$$

A charge change measured as above of less than 5 μC/g was evaluated as good, and a charge change measured as above of at least 5 μC/g was evaluated as poor.

[Evaluation Results]

Table 4 indicates evaluation results for the respective toners TB-1 to TB-14. Table 4 lists respective evaluation results of the high-temperature preservability (agglomeration), the low-temperature fixability (minimum fixing temperature), the charge rise characteristic (charge rise constant), and the charge stability (charge decay constant and charge change).

TABLE 4

| | Toner | High-temperature preservability [% by mass] | Low-temperature fixability [° C.] | Charge rise characteristic [μC/g] | Charge stability: Decay characteristic | Charge stability: Change amount [μC/g] |
|---|---|---|---|---|---|---|
| Example 6 | TB-1 | 18 | 122 | 20 | 0.018 | 1 |
| Example 7 | TB-2 | 16 | 124 | 23 | 0.019 | 1 |
| Example 8 | TB-3 | 13 | 124 | 25 | 0.021 | 1 |
| Example 9 | TB-4 | 8 | 126 | 29 | 0.024 | 2 |
| Example 10 | TB-5 | 4 | 129 | 36 | 0.028 | 3 |
| Example 11 | TB-6 | 16 | 123 | 20 | 0.018 | 1 |
| Example 12 | TB-7 | 15 | 124 | 23 | 0.019 | 1 |
| Example 13 | TB-8 | 10 | 125 | 25 | 0.021 | 2 |
| Example 14 | TB-9 | 5 | 126 | 29 | 0.024 | 3 |
| Example 15 | TB-10 | 2 | 129 | 36 | 0.028 | 3 |
| Example 16 | TB-11 | 25 | 123 | 20 | 0.018 | 2 |
| Comparative Example 4 | TB-12 | 27 (poor) | 119 | 4 (poor) | 0.016 | 3 |
| Comparative Example 5 | TB-13 | 3 | 128 | 38 | 0.035 (poor) | 5 (poor) |
| Comparative Example 6 | TB-14 | 19 | 126 | 10 (poor) | 0.016 | 1 |

The toners TB-1 to TB-11 (toners according to Examples 6-16) each had the aforementioned basic features. Specifically the toners TB-1 to TB-11 each included shell layers containing a copolymer of at least two vinyl compounds including a compound represented by the above formula (1) (specifically, a copolymer of methyl methacrylate and a compound (1) containing a hydrogen atom as $R^1$). As indicated in Table 3, the toners each contained a ring unopened oxazoline group in an amount of at least 0.10 μmol/g and no greater than 100 μmol/g. As further indicated in Table 3, the external additive attached to the surfaces of the toner mother particles contained a plurality of inorganic particles (specifically, silica particles) and a plurality of crosslinked resin particles having a glass transition point of at least 100° C. and no greater than 150° C. The crosslinked resin particles and the inorganic particles constitute a stacked structure (lower: heat resistant resin powder, upper silica particles) in the order of the crosslinked resin particles and the inorganic particles from the side of a toner mother particle. As indicated in Table 4, the toners TB-1 to TB-11 each were excellent in high-temperature preservability, low-temperature fixability, charge rise characteristic, and charge stability (charge decay constant and charge change).

Image analysis on SEM pictures of the toner particles found that the shell layers covered at least 70% and no greater than 80% of a total surface area of the toner cores in each of the toners TB-1 to TB-11.

The invention claimed is:

1. An electrostatic latent image developing toner comprising a plurality of toner particles each including a core containing a binder resin and a shell layer covering a surface of the core, wherein the shell layer contains a copolymer of at least two vinyl compounds including a compound represented by formula (1) shown below, and the toner contains a ring unopened oxazoline group in an amount of at least 0.10 μmol/g and no greater than 100 μmol/g:

(1)

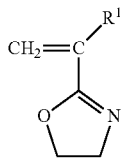

where, in the formula (1), $R^1$ represents a hydrogen atom or an optionally substituted alkyl group.

2. The electrostatic latent image developing toner according to claim 1, wherein the at least two vinyl compounds include at least one vinyl compound selected from the group consisting of styrene-based monomers and acrylic acid-based monomers.

3. The electrostatic latent image developing toner according to claim 1, wherein the copolymer contained in the shell layer is a copolymer of monomers including the at least one compound represented by the formula (1) and at least one (meth) acrylic acid alkyl ester.

4. The electrostatic latent image developing toner according to claim 1, wherein the toner particles each include a toner mother particle and an external additive, the toner mother particle including the core and the shell layer, the external additive being attached to a surface of the toner mother particle, and the external additive contains a resin powder that is a powder of crosslinked resin particles having a glass transition point of at least 100° C.

5. The electrostatic latent image developing toner according to claim 4, wherein the external additive contains the resin powder and an inorganic powder that is a powder of inorganic particles, and the resin powder and the inorganic powder constitute a stacked structure in order of the resin powder and the inorganic powder from a side of the toner mother particle.

6. The electrostatic latent image developing toner according to claim 5, wherein the resin powder has a number average primary particle diameter of at least 70 nm and no greater than 95 nm, and the inorganic powder includes a powder of silica particles having a number average primary particle diameter of at least 5 nm and no greater than 40 nm.

7. The electrostatic latent image developing toner according to claim 6, wherein the resin powder is present in an amount of at least 0.5 parts by mass and no greater than 5.0 parts by mass relative to 100 parts by mass of the toner mother particles, and the powder of the silica particles is present in an amount of at least 0.5 parts by mass and no greater than 5.0 parts by mass relative to 100 parts by mass of the toner mother particles.

8. The electrostatic latent image developing toner according to claim 5, wherein the shell layers cover at least 70% and no greater than 80% of a total surface area of the toner cores.

9. The electrostatic latent image developing toner according to claim 6, wherein the crosslinked resin particles having a glass transition point of at least 100° C. contain a crosslinked acrylic acid-based resin.

10. The electrostatic latent image developing toner according to claim 9, wherein the core contains a polyester resin as the binder resin.

11. The electrostatic latent image developing toner according to claim 10, wherein the polyester resin is a condensation polymer of at least one aromatic dibasic carboxylic acid and at least one aliphatic diol having a carbon number of at least 2 and no greater than 4.

12. The electrostatic latent image developing toner according to claim 10, wherein the core is a pulverized core.

* * * * *